US008961646B2

(12) United States Patent
Gu et al.

(10) Patent No.: US 8,961,646 B2
(45) Date of Patent: Feb. 24, 2015

(54) NICKEL ALLOY

(75) Inventors: Yuefeng Gu, Ibaraki (JP); Tadaharu Yokokawa, Ibaraki (JP); Toshiharu Kobayashi, Ibaraki (JP); Toshio Osada, Ibaraki (JP); Junzo Fujioka, Ibaraki (JP); Hiroshi Harada, Ibaraki (JP); Daisuke Nagahama, Saitama (JP); Yusuke Kikuchi, Saitama (JP)

(73) Assignees: Honda Motor Co., Ltd., Tokyo (JP); National Institute for Materials Science, Ibaraki (JP)

( * ) Notice: Subject to any disclaimer, the term of this patent is extended or adjusted under 35 U.S.C. 154(b) by 0 days.

(21) Appl. No.: 13/821,975

(22) PCT Filed: Nov. 9, 2011

(86) PCT No.: PCT/JP2011/075861

§ 371 (c)(1),
(2), (4) Date: Mar. 9, 2013

(87) PCT Pub. No.: WO2012/063879

PCT Pub. Date: May 18, 2012

(65) Prior Publication Data

US 2013/0167687 A1 Jul. 4, 2013

(30) Foreign Application Priority Data

Nov. 10, 2010 (JP) ..... 2010-251967

(51) Int. Cl.
*B22F 1/00* (2006.01)
*C22C 19/05* (2006.01)
(Continued)

(52) U.S. Cl.
CPC ..... *C22C 30/00* (2013.01); *C22C 19/056* (2013.01); *C22C 19/057* (2013.01); *C22C 1/0433* (2013.01)
USPC ..... 75/228; 420/588

(58) Field of Classification Search
CPC ..... B21J 5/00; C22F 1/10
USPC ..... 75/228; 420/588
See application file for complete search history.

(56) References Cited

U.S. PATENT DOCUMENTS 3,746,581 A 7/1973 Cairns et al.
3,890,816 A 6/1975 Allen et al.
(Continued)

FOREIGN PATENT DOCUMENTS

CA 2746240 A1 1/2012
EP 0849370 A 6/1998
(Continued)

OTHER PUBLICATIONS

Search Report from European Patent Office, dated Jan. 16, 2014, from corresponding European patent application No. 11839651.4 (4 pages).
(Continued)

*Primary Examiner* — Kaj K Olsen
*Assistant Examiner* — Alexander Polyansky
(74) *Attorney, Agent, or Firm* — Capitol City TechLaw, PLLC

(57) ABSTRACT

There is provided a nickel alloy having an excellent creep strength as well as high-temperature oxidation resistance. The nickel alloy of the present invention comprises, by mass percent, Cr in a range of 11.5 to 11.9%, Co in a range of 25 to 29%, Mo in a range of 3.4 to 3.7%, W in a range of 1.9 to 2.1%, Ti in a range of 3.9 to 4.4%, Al in a range of 2.9 to 3.2%, C in a range of 0.02 to 0.03%, B in a range of 0.01 to 0.03%, Zr in a range of 0.04 to 0.06%, Ta in a range of 2.1 to 2.2%, Hf in a range of 0.3 to 0.4%, and Nb in a range of 0.5 to 0.8%, the balance being Ni and unavoidable impurities, and contains carbides and borides precipitating in crystal grains and at grain boundaries.

2 Claims, 4 Drawing Sheets

(51) Int. Cl.
*C22C 1/04* (2006.01)
*C22C 30/00* (2006.01)

(56) References Cited

U.S. PATENT DOCUMENTS

| | | | | |
|---|---|---|---|---|
| 4,574,015 | A | 3/1986 | Genereux et al. | |
| 4,579,602 | A * | 4/1986 | Paulonis et al. | 148/677 |
| 6,521,175 | B1 | 2/2003 | Mourer et al. | |
| 6,974,508 | B1 | 12/2005 | Gabb et al. | |
| 8,608,877 | B2 | 12/2013 | DiDomizio et al. | |
| 2005/0047954 | A1 | 3/2005 | Hieber et al. | |
| 2007/0199629 | A1 | 8/2007 | James et al. | |
| 2007/0202002 | A1 | 8/2007 | James et al. | |
| 2007/0202003 | A1 | 8/2007 | Arrell et al. | |
| 2008/0101981 | A1 | 5/2008 | Arrell et al. | |
| 2009/0087338 | A1 | 4/2009 | Mitchell et al. | |
| 2011/0088817 | A1 * | 4/2011 | Mitchell | 148/514 |

FOREIGN PATENT DOCUMENTS

| | | | |
|---|---|---|---|
| EP | 1 195 446 | A1 | 4/2002 |
| EP | 2045345 | A | 4/2009 |
| FR | 2244827 | A | 4/1975 |
| JP | 2008-525634 | A | 7/2008 |
| JP | 2008525634 | A | 7/2008 |
| JP | 2009-097094 | A | 5/2009 |
| WO | 2006/059805 | A1 | 6/2006 |

OTHER PUBLICATIONS

Canadian Intellectual Property Office, Office Action dated Nov. 3, 2014, issued in corresponding Canadian counterpart application, No. 2,810,504 (5 pages).

* cited by examiner

NICKEL ALLOY

TECHNICAL FIELD

The present invention relates to a nickel alloy.

BACKGROUND ART

Conventionally, nickel alloys have been used for heat-resistant members of aircraft engines, gas turbines for power generation, and the like, especially for turbine discs. The heat-resistant members such as the turbine discs are required to have high-temperature oxidation resistance and also be excellent in strength such as creep strength and fatigue strength.

To meet this requirement, a nickel alloy with high-temperature oxidation resistance provided by the addition of chromium has been proposed. As the nickel alloy, there has been known a nickel alloy containing, with respect to the total quantity, Cr in a range of 2 to 25% by mass, Co in a range of 19.5 to 55% by mass, up to 10% by mass of Mo, up to 10% by mass of W, Ti in a range of 3 to 15% by mass, Al in a range of 0.2 to 7% by mass, up to 0.05% by mass of C, up to 0.05% by mass of B, up to 0.5% by mass of Zr, up to 10% by mass of Ta, up to 2% by mass of Hf, and up to 5% by mass of Nb (refer to Patent Literature 1).

Also, as the above-described nickel alloy, there has been known a nickel alloy containing, with respect to the total quantity, Co in a range of 20 to 40% by mass, Cr in a range of 10 to 15% by mass, Mo in a range of 3 to 6% by mass, Win a range of 0 to 5% by mass, Ti in a range of 3.4 to 5% by mass, Al in a range of 2.5 to 4% by mass, C in a range of 0.01 to 0.05% by mass, B in a range of 0.01 to 0.05% by mass, Zr in a range of 0 to 0.1% by mass, Ta in a range of 1.35 to 2.5% by mass, Hf in a range of 0.5 to 1% by mass, and Nb in a range of 0 to 2% by mass (refer to Patent Literature 2).

Further, as the above-described nickel alloy, there has been known a nickel alloy containing, with respect to the total quantity, Cr in a range of 11 to 15% by mass, Co in a range of 14 to 23% by mass, Mo in a range of 2.7 to 5% by mass, W in a range of 0.5 to 3% by mass, Ti in a range of 3 to 6% by mass, Al in a range of 2 to 5% by mass, C in a range of 0.015 to 0.1% by mass, B in a range of 0.015 to 0.045% by mass, Zr in a range of 0.015 to 0.15% by mass, Ta in a range of 0.5 to 4% by mass, Hf in a range of 0 to 2% by mass, and Nb in a range of 0.25 to 3% by mass (refer to Patent Literature 3).

CITATION LIST

Patent Literature

Patent Literature 1: International Publication No. WO2006/059805

Patent Literature 2: U.S. Patent Application Publication No. 2009/0087338

Patent Literature 3: European Patent Application Publication No. 1195446

SUMMARY OF INVENTION

Technical Problem

Unfortunately, the conventional nickel alloys are formed with a TCP (Topologically close packed) phase consisting of Mo, Cr and W, and therefore a sufficient creep strength cannot be attained, or a rupture sometimes occurs with the TCP phase being a starting point on account of creep deformation.

An object of the present invention is to solve such a problem, and to provide a nickel alloy having an excellent creep strength as well as high-temperature oxidation resistance.

Solution to Problem

The present inventors earnestly studied the compositions of the conventional nickel alloys, and resultantly found that by making the composition a further restricted specific composition, the TCP phase can be restricted from being formed, and thereby a nickel alloy that has high-temperature oxidation resistance and also has an excellent creep strength can be obtained.

The invention of the nickel alloy was made based on the above findings, and to achieve the above-described object, the nickel alloy of the present invention comprises, with respect to the total quantity, Cr in a range of 11.5 to 11.9% by mass, Co in a range of 25 to 29% by mass, Mo in a range of 3.4 to 3.7% by mass, Win a range of 1.9 to 2.1% by mass, Ti in a range of 3.9 to 4.4% by mass, Al in a range of 2.9 to 3.2% by mass, C in a range of 0.02 to 0.03% by mass, B in a range of 0.01 to 0.03% by mass, Zr in a range of 0.04 to 0.06% by mass, Ta in a range of 2.1 to 2.2% by mass, Hf in a range of 0.3 to 0.4% by mass, and Nb in a range of 0.5 to 0.8% by mass, the balance being Ni and unavoidable impurities, and is characterized by containing carbides and borides precipitating in crystal grains and at grain boundaries.

For the nickel alloy of the present invention, by the above-described composition that the nickel alloy has, an excellent high-temperature oxidation resistance can be attained. Also, in the nickel alloy of the present invention, carbides and borides of Mo, Cr, W, Hf, Zr and Ta precipitate in crystal grains and at grain boundaries. According to the nickel alloy of the present invention, the precipitation of the carbides and borides restrains the TCP phase from being formed, so that an excellent creep strength can be attained.

As the nickel alloy of the present invention, a nickel alloy manufactured, for example, by powder metallurgy can be used.

DESCRIPTION OF EMBODIMENTS

Figure 1:
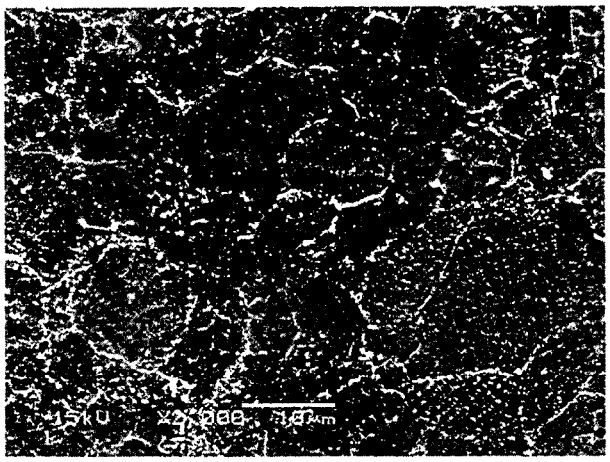
FIG. 1 is an electron micrograph showing one example of microstructure of a nickel alloy in accordance with the present invention.

An embodiment of the present invention will now be described in more detail with reference to the accompanying drawings.

The nickel alloy of this embodiment is manufactured by powder metallurgy, and comprises, with respect to the total quantity, Cr in a range of 11.5 to 11.9% by mass, Co in a range of 25 to 29% by mass, Mo in a range of 3.4 to 3.7% by mass, W in a range of 1.9 to 2.1% by mass, Ti in a range of 3.9 to 4.4% by mass, Al in a range of 2.9 to 3.2% by mass, C in a range of 0.02 to 0.03% by mass, B in a range of 0.01 to 0.03% by mass, Zr in a range of 0.04 to 0.06% by mass, Ta in a range of 2.1 to 2.2% by mass, Hf in a range of 0.3 to 0.4% by mass, and Nb in a range of 0.5 to 0.8% by mass, the balance being Ni and unavoidable impurities. Also, in the nickel alloy of this embodiment, carbides and borides of Mo, Cr, W, Hf, Zr and Ta precipitate in crystal grains and at grain boundaries.

For the nickel alloy of this embodiment, by adding Co together with Cr of the content in the above-described range to the alloy composition, an excellent high-temperature oxidation resistance can be obtained. Also, for the nickel alloy of this embodiment, by adding Co of the content in the above-described range to the alloy composition, the addition amount of Cr can be reduced, so that the TCP phase is restricted from being formed, and thereby the stability of structure is improved.

Also, for the nickel alloy of this embodiment, by adding Mo and W of the contents in the above-described range to the alloy composition together with the addition of Co and Ti of the contents in the above-described range, the carbides are precipitated in large amounts in the parent phase. At this time, the carbides are converted into fine grains and are dispersed in the parent phase, so that the high-temperature strength can be improved further.

Also, for the nickel alloy of this embodiment, by adding Co and Ti of the contents in the above-described range to the alloy composition, the ratio of solid dissolution of Mo and W into γ' (gamma prime) phase is increased. As a result, according to the nickel alloy of this embodiment, the high-temperature strength can be improved further.

The nickel alloy of this embodiment is manufactured by powder metallurgy as described above; however, the nickel alloy of the present invention is not limited to a nickel alloy manufactured by powder metallurgy, and may be manufactured by any other process. As other processes for manufacturing the nickel alloy of the present invention, for example, casting, refining, and forging can be cited.

In the following, working examples and comparative examples are described.

EXAMPLES

Working Example 1

In working example 1, a nickel alloy comprising, with respect to the total quantity, 11.7% by mass of Cr, 25.0% by mass of Co, 3.4% by mass of Mo, 1.9% by mass of W, 4.2% by mass of Ti, 3.2% by mass of Al, 0.025% by mass of C, 0.02% by mass of B, 0.05% by mass of Zr, 2.2% by mass of Ta, 0.35% by mass of Hf, and 0.8% by mass of Nb, the balance being Ni and unavoidable impurities, was manufactured by powder metallurgy. A scanning electron micrograph (magnification: ×2000) of the crystalline structure of the nickel alloy obtained in this working example is shown in FIG. 1.

As shown in FIG. 1, in the nickel alloy obtained in this working example, white and fine carbides and borides precipitate in crystal grains so as to be dispersed uniformly. Also, in the nickel alloy obtained in this working example, white carbides and borides precipitate at grain boundaries. However, in the nickel alloy obtained in this working example, the TCP phase is not formed at all.

Figure 2:
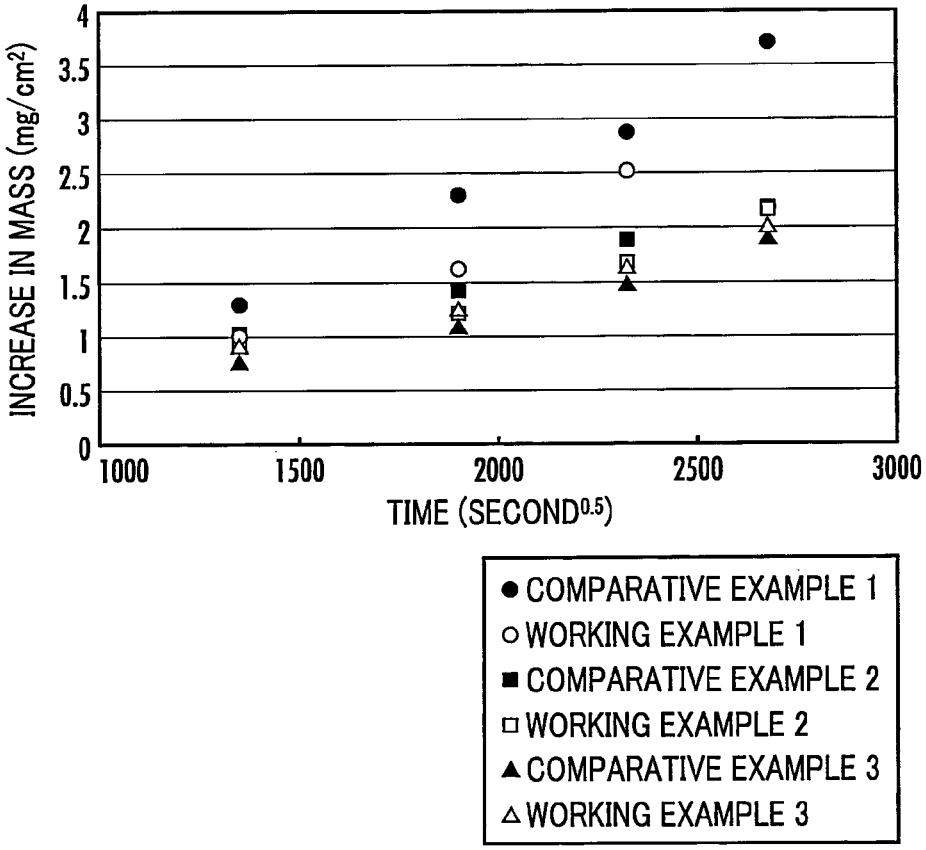
FIG. 2 is a graph showing the high-temperature oxidation of a nickel alloy in accordance with the present invention.

Next, the high-temperature oxidation resistance of the nickel alloy obtained in this working example was measured by the isothermal oxidation test at 850° C. The measurement result is shown in FIG. 2 as an increase in mass (mg/cm$^2$) per unit area with respect to the square root of time. The increase in mass is caused by the formation of oxides at a temperature of 850° C., and indicates that the smaller the increase in mass is, the higher the high-temperature oxidation resistance is.

Next, the creep strength of the nickel alloy obtained in this working example was measured as a change in stress load (MPa) with respect to the Larson-Miller parameter.

Figure 3:
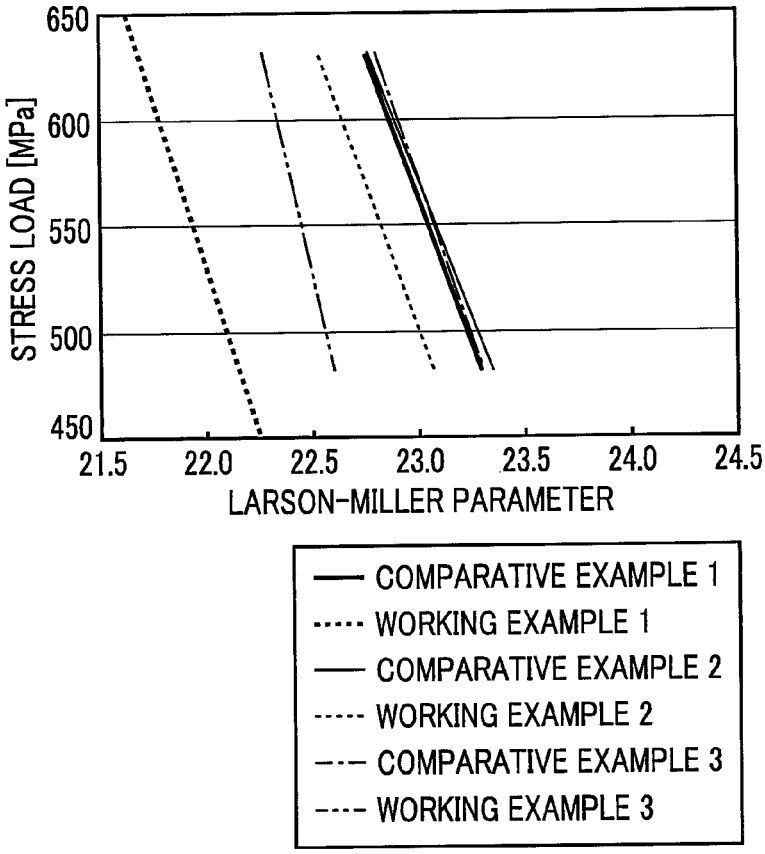
FIG. 3 is a graph showing the creep strength of a nickel alloy in accordance with the present invention.

The Measurement Result is Shown in FIG. 3.

The Larson-Miller parameter (LMP) is a value expressed by the following formula.

$$LMP=T(C+\log t)/1000$$

in which, T is absolute temperature (K), t is time (hour), and C is a constant depending on metal. In this working example, C was set so as to be equal to 20.

Working Example 2

In working example 2, a nickel alloy having the same chemical composition as in working example 1 except that, with respect to the total quantity, the Co content was 27.0% by mass, the Ti content was 4.4% by mass, and the Nb content was 0.5% by mass was manufactured. A scanning electron micrograph (magnification: ×2000) of the microstructure of the nickel alloy obtained in this working example is shown in FIG. 4.

Figure 4:
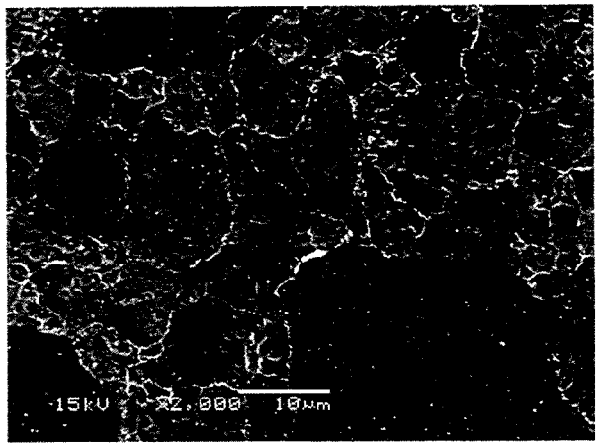
FIG. 4 is an electron micrograph showing another example of microstructure of a nickel alloy in accordance with the present invention.

As shown in FIG. 4, in the nickel alloy obtained in this working example, white and fine carbides and borides precipitate in crystal grains so as to be dispersed uniformly. Also, in the nickel alloy obtained in this working example, white carbides and borides precipitate at grain boundaries. However, in the nickel alloy obtained in this working example, the TCP phase is not formed at all.

Next, the high-temperature oxidation resistance of the nickel alloy obtained in this working example was measured in completely the same way as in working example 1.

The Measurement Result is Shown in FIG. 2.

Next, the creep strength of the nickel alloy obtained in this working example was measured in completely the same way as in working example 1. The measurement result is shown in FIG. 3.

Working Example 3

In working example 3, a nickel alloy having the same chemical composition as in working example 1 except that, with respect to the total quantity, the Co content was 29.0% by mass, the Mo content was 3.7% by mass, the W content was 2.1% by mass, the Ti content was 3.9% by mass, the Al content was 2.9% by mass, the Ta content was 2.1% by mass, and the Nb content was 0.5% by mass was manufactured. A scanning electron micrograph (magnification: ×2000) of the microstructure of the nickel alloy obtained in this working example is shown in FIG. 5.

Figure 5:
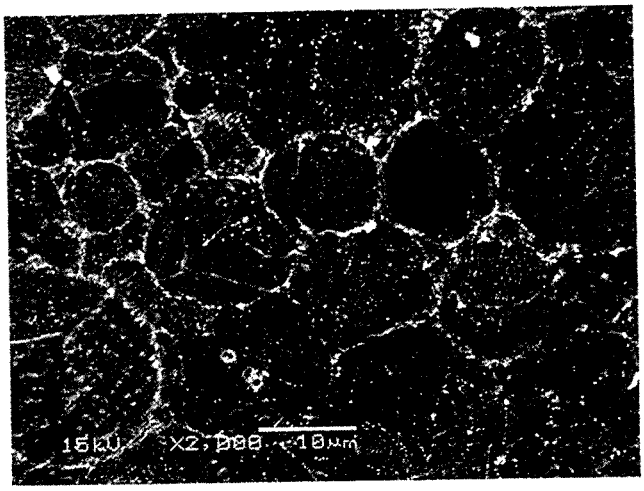
FIG. 5 is an electron micrograph showing still another example of microstructure of a nickel alloy in accordance with the present invention.

As shown in FIG. 5, in the nickel alloy obtained in this working example, white and fine carbides and borides precipitate in crystal grains so as to be dispersed uniformly. Also, in the nickel alloy obtained in this working example, white carbides and borides precipitate at grain boundaries. However, in the nickel alloy obtained in this working example, the TCP phase is not formed at all.

Next, the high-temperature oxidation resistance of the nickel alloy obtained in this working example was measured in completely the same way as in working example 1. The Measurement Result is Shown in FIG. 2.

Next, the creep strength of the nickel alloy obtained in this working example was measured in completely the same way as in working example 1. The measurement result is shown in FIG. 3.

Comparative Example 1

In comparative example 1, a nickel alloy comprising, with respect to the total quantity, 16.0% by mass of Cr, 15.0% by mass of Co, 3.0% by mass of Mo, 1.25% by mass of W, 5.0% by mass of Ti, 2.5% by mass of Al, 0.025% by mass of C, 0.02% by mass of B, and 0.03% by mass of Zr, the balance being Ni and unavoidable impurities, was manufactured by powder metallurgy. A scanning electron micrograph (magnification: ×2000) of the microstructure of the nickel alloy obtained in this comparative example is shown in FIG. 6.

Figure 6:
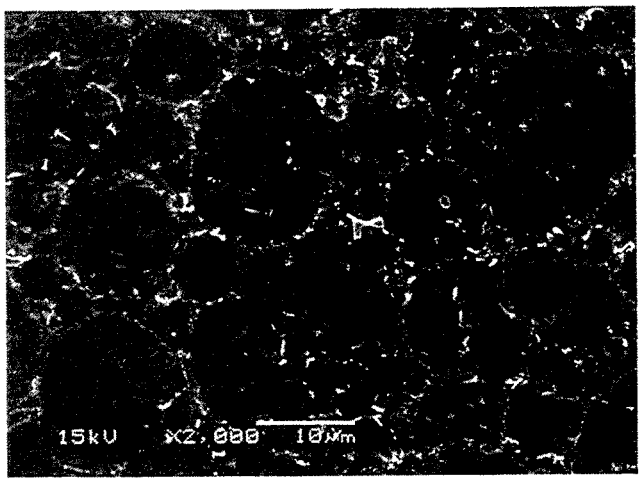
FIG. 6 is an electron micrograph showing one example of microstructure of a conventional nickel alloy.

As shown in FIG. 6, in the nickel alloy obtained in this comparative example, white and fine carbides and borides precipitate in crystal grains so as to be dispersed uniformly. Also, in the nickel alloy obtained in this comparative example, white carbides and borides precipitate at grain boundaries. Furthermore, in the nickel alloy obtained in this comparative example, a plate-shaped or needle-shaped TCP phase precipitates in crystal grains, and a gray TCP phase precipitates at grain boundaries.

Next, the high-temperature oxidation resistance of the nickel alloy obtained in this comparative example was measured in completely the same way as in working example 1. The measurement result is shown in FIG. 2.

Next, the creep strength of the nickel alloy obtained in this comparative example was measured in completely the same way as in working example 1. The measurement result is shown in FIG. 3.

Comparative Example 2

In comparative example 2, a nickel alloy comprising, with respect to the total quantity, 12.5% by mass of Cr, 27.0% by mass of Co, 3.4% by mass of Mo, 1.9% by mass of W, 4.4% by mass of Ti, 3.2% by mass of Al, 0.025% by mass of C, 0.02% by mass of B, 0.05% by mass of Zr, 2.5% by mass of Ta, 0.35% by mass of Hf, and 0.5% by mass of Nb, the balance being Ni and unavoidable impurities, was manufactured by powder metallurgy. A scanning electron micrograph (magnification: ×2000) of the microstructure of the nickel alloy obtained in this comparative example is shown in FIG. 7.

Figure 7:
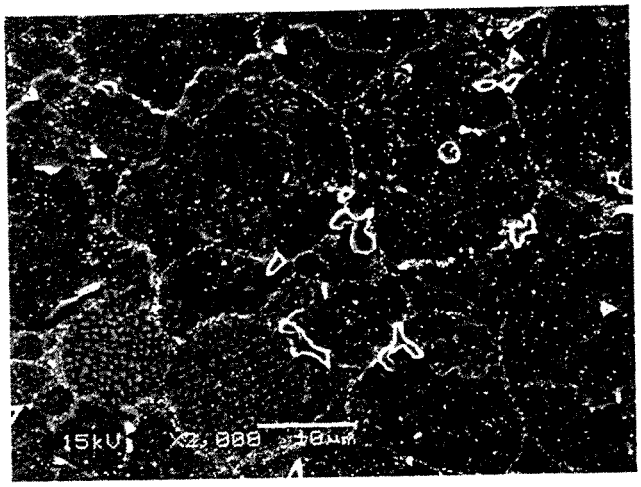
FIG. 7 is an electron micrograph showing another example of microstructure of a conventional nickel alloy.

As shown in FIG. 7, in the nickel alloy obtained in this comparative example, white and fine carbides and borides precipitate in crystal grains so as to be dispersed uniformly. Also, in the nickel alloy obtained in this comparative example, white carbides and borides precipitate at grain boundaries. Furthermore, in the nickel alloy obtained in this comparative example, a plate-shaped or needle-shaped TCP phase precipitates in crystal grains, and a gray TCP phase precipitates at grain boundaries.

Next, the high-temperature oxidation resistance of the nickel alloy obtained in this comparative example was measured in completely the same way as in working example 1. The Measurement Result is Shown in FIG. 2.

Next, the creep strength of the nickel alloy obtained in this comparative example was measured in completely the same way as in working example 1. The measurement result is shown in FIG. 3.

Comparative Example 3

In comparative example 3, a nickel alloy having the same chemical composition as in comparative example 2 except that, with respect to the total quantity, the Co content was 25.0% by mass, the Mo content was 4.5% by mass, and the W content was 2.1% by mass was manufactured. A scanning electron micrograph (magnification: ×2000) of the microstructure of the nickel alloy obtained in this comparative example is shown in FIG. 8.

Figure 8:
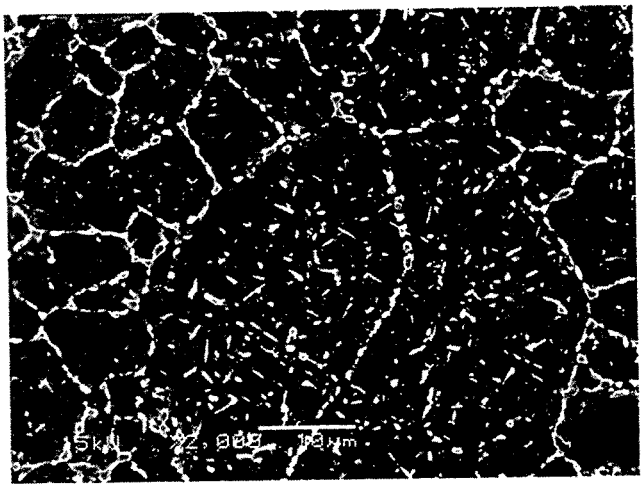
FIG. 8 is an electron micrograph showing still another example of microstructure of a conventional nickel alloy.

As shown in FIG. 8, in the nickel alloy obtained in this comparative example, white and fine carbides and borides precipitate in crystal grains so as to be dispersed uniformly. Also, in the nickel alloy obtained in this comparative example, white carbides and borides precipitate at grain boundaries. Furthermore, in the nickel alloy obtained in this comparative example, a plate-shaped or needle-shaped TCP phase precipitates in crystal grains, and a gray TCP phase precipitates at grain boundaries.

Next, the high-temperature oxidation resistance of the nickel alloy obtained in this comparative example was measured in completely the same way as in working example 1. The Measurement Result is Shown in FIG. 2.

Next, the creep strength of the nickel alloy obtained in this comparative example was measured in completely the same way as in working example 1. The measurement result is shown in FIG. 3.

For the nickel alloys obtained in working examples 1 to 3, as shown in FIG. 2, the increase in mass per unit area caused by the formation of oxides at a temperature of 850° C. is small over a long period of time, and therefore it is apparent that the nickel alloys each have an excellent high-temperature oxidation resistance. Also, it is apparent that the nickel alloys obtained in working examples 1 to 3 each have an excellent creep strength as shown in FIG. 3.

For the nickel alloy obtained in comparative example 1, as shown in FIG. 2, the increase in mass per unit area is large, and therefore it is apparent that the nickel alloy has a poor high-temperature oxidation resistance as compared with the nickel alloys obtained in working examples 1 to 3. On the other hand, for the nickel alloys obtained in comparative examples 2 and 3, as shown in FIG. 2, the increase in mass per unit area is equivalent to the increases in mass per unit area of the nickel alloys obtained in working examples 1 to 3; however, it is apparent that the nickel alloys each have a low creep strength as compared with the nickel alloys obtained in working examples 1 to 3 as shown in FIG. 3.

The invention claimed is:

1. A nickel alloy consisting of, with respect to the total quantity, Cr in a range of 11.5 to 11.9% by mass, Co in a range of 25 to 29% by mass, Mo in a range of 3.4 to 3.7% by mass, W in a range of 1.9 to 2.1% by mass, Ti in a range of 3.9 to 4.4% by mass, Al in a range of 2.9 to 3.2% by mass, C in a range of 0.02 to 0.03% by mass, B in a range of 0.01 to 0.03% by mass, Zr in a range of 0.04 to 0.06% by mass, Ta in a range of 2.1 to 2.2% by mass, Hf in a range of 0.3 to 0.4% by mass, and Nb in a range of 0.5 to 0.8% by mass, the balance being Ni and unavoidable impurities, wherein the nickel alloy comprises carbides and borides precipitating in crystal grains and at grain boundaries.

2. The nickel alloy according to claim 1, wherein the nickel alloy is manufactured by powder metallurgy.

* * * * *